United States Patent [19]

Berlin et al.

[11] Patent Number: 4,916,757

[45] Date of Patent: Apr. 17, 1990

[54] PLASTIC GLOVE HAVING A TRIGGER FINGER AND PROVIDED WITH LATERAL RECEPTACLES AND RELATED METHOD AND TOOLING

[75] Inventors: Frank Berlin, New York, N.Y.; Leonard McGuire; Eugene E. Campbell, both of Tulsa, Okla.

[73] Assignee: Armin, Jersey City, N.J.

[21] Appl. No.: 176,714

[22] Filed: Apr. 1, 1988

[51] Int. Cl.[4] ..... A41D 19/00

[52] U.S. Cl. ..... 2/159; 2/161 R; 2/163; 2/168; 2/169; D2/621

[58] Field of Search ..... 2/159, 158, 16 R, 163, 2/168, 169; D2/621

[56] References Cited

U.S. PATENT DOCUMENTS

| | | | |
|---|---|---|---|
| 1,441,251 | 1/1923 | Steffens | 2/161 R |
| 1,713,065 | 5/1929 | Williams | 2/161 R X |
| 2,745,128 | 5/1956 | Zeuner | 2/158 X |
| 2,782,912 | 2/1957 | Humphrey | 2/158 X |
| 2,847,676 | 8/1958 | Scott | 2/159 |
| 3,229,875 | 1/1966 | Stoller | 2/169 X |
| 3,387,307 | 6/1968 | Blatz | 2/167 |
| 4,034,853 | 7/1977 | Smith | 2/169 X |
| 4,752,973 | 6/1988 | Wolfberg et al. | 2/163 |

*Primary Examiner*—H. Hampton Hunter

*Attorney, Agent, or Firm*—Roberts, Spiecens & Cohen

[57] ABSTRACT

A glove is formed of plastic films which are sealed together along lateral edges between which is formed a peripheral seal in the form of a contour providing thumb, forefinger and further receptacles. The further receptacle is intended to accommodate three fingers. In this arrangement, interior seals are provided which are in part spaced from the lateral edges and parallel thereto but which merge with the respective lateral edges to form lateral receptacles between which is an opening for the penetration of the hand of the user. The films are processed by bringing two films together and forming the contour seal thereon while forming at the lateral edges a rectilinear seal having on opposite sides thereof the adjacent interior seals of two successive gloves. The successive gloves are made separable by the provision of a line of perforations which are formed in correspondence with the lateral seals.

25 Claims, 3 Drawing Sheets

PLASTIC GLOVE HAVING A TRIGGER FINGER AND PROVIDED WITH LATERAL RECEPTACLES AND RELATED METHOD AND TOOLING

FIELD OF INVENTION

This invention relates to plastic gloves formed of plastic films and more particularly, to gloves having receptacles for thumbs, forefingers and other fingers of the hands of the users thereof. This invention also relates to methods and tooling for the manufacture of the above-mentioned gloves.

BACKGROUND

In researching the prior art patents relative to the filing of the present application, I have become aware of the following U.S. Pat. Nos. 2,435,890; 2,847,676; 3,387,307; 3,229,375; 4,034,953; and Des. 253,920.

In U.S. Pat. No. 2,435,890, B. Lembeck illustrates a glove which has a thumb receiving pocket and a finger receiving pocket. This structure is not fabricated of plastic film and is not provided with the various features of the present invention.

N. C. Scott in U.S. Pat. No. 2,847,676 disclosed an economical handprotective device in the form of a surgical glove which includes three finger pockets in addition to a thumb pocket. This surgical glove can be formed of polyethylene. However, the disclosed structure is not conveniently adapted to mass production techniques as is the present invention and various features of the present invention are absent from Scott's structure as will become apparent hereinbelow.

In U.S. Pat. No. 3,387,307, R. A. Blatz illustrates the manufacture of plastic gloves. Two sheets of thermoplastic material are fused together along a hand outline or the like and a blowing technique employed for the distribution of talc is acknowledged as constituting prior art. It can readily be observed by the illustration of the glove disclosed in this patent that it lacks numerous features of the present invention.

D. Stoller in U.S. Pat. No. 3,229,375 discloses the concept of rolls of disposable articles of apparel arranged in series. The serial conformation which is illustrated is different from that envisaged according to the present invention. In addition, it will be readily noted from what is described hereinbelow that the invention provides numerous features not contemplated by Stoller.

B. Smith in U.S. Pat. No. 4,034,853 reveals disposable plastic-film gloves prepared from strip film material in two layers which are heat sealed in the outline of a glove with five fingers and are simultaneously diecut to remove the material between the fingers and to the side and base of the respective gloves. The removal of material from the sides of gloves is unnecessary in accordance with the present invention and, as a matter of fact, this material is usefully employed in accordance with the present invention.

In Design U.S. Pat. No. 253,920 is revealed a design for a molded glove. It will become quite clear hereinafter that this glove is substantially different from the glove of the invention.

SUMMARY OF INVENTION

It is an object of the invention to provide an improved plastic glove formed of plastic films.

It is a further object of the invention to provide improved plastic gloves having provisions for trigger fingers.

Yet another object of the invention is to provide improved plastic gloves having receptacles for thumbs, forefingers and the remaining fingers of the hands of the users thereof.

Yet another object of the invention is to provide an improved plastic glove of a type having at least one lateral receptacle included therein and having a necked down wrist portion.

Still another object of the invention is to provide an improved design for a plastic glove in accordance with which lateral receptacles are provided on opposite lateral edges of the construction.

Still a further object of the invention is to provide for methods and tooling to provide improved plastic gloves of the above indicated generalized type.

In achieving the above and other objects of the invention, there is provided an article of manufacture comprising a hand covering including plastic films in face-to-face relation and having peripheral seals in part providing a contour defining thumb and forefinger receptacles and a further receptacle for three fingers. These films have connected lateral edges and edges distal from the aforesaid receptacles. The films furthermore have interior seals in substantial portion spaced from the aforesaid lateral edges. The edges distal from the receptacles are separate from each other except at the lateral and interior seals and, between the interior seals, being separate thereby defining an opening whereby access is provided for a hand.

In a preferred embodiment of the invention, the interior seals merge with the peripheral seals adjacent the thumb and further receptacles and the interior seals and the lateral edges define lateral receptacles. The interior seals are preferably spaced from each other by a distance which is about three to four times the distance between the interior seals and the related lateral edges. More specifically, the distance between the interior seals is in the order of magnitude of about 5½ inches. Specifically, also, the distance between each of the interior seals and the related lateral edge is in the order of magnitude of about 1½ inches.

According to a further feature of the invention, the forefinger receptacle has generally parallel lateral edges spaced by a distance in the order of magnitude of about 1½ inches. Moreover the forefinger receptacle terminates preferably in a generally semi-circular end seal having a radius in the order of magnitude of about three-quarters of an inch.

According to another feature of the invention, the forefinger and further receptacles have facing lateral edges which diverge at an angle relative to each other, this angle being preferably in the order of magnitude of about twenty degrees. It will be seen in the description which follows hereinbelow that the further receptacle terminates in a generally semi-circular end seal which is part of the peripheral seal and has a radius in the order of magnitude of about 1½ inches. It will further be noted that the lateral edges of the forefinger receptacle are generally parallel to the lateral edges of the films.

In further accordance with the invention, the thumb and forefinger receptacles have facing lateral edges which diverge at an angle in the order of magnitude of about 25 degrees. Moreover the lateral edges of the film are spaced at a distance in the order of magnitude of about 8½ inches. It should be noted that the facing lateral edges referred to above merge along a curvature having a radius in the order of magnitude of about 3/16th of an inch.

In the description which follows hereinbelow, the thumb receptacle, it will be noted, terminates at a distance in the order of magnitude of about 8½ inches from the aforementioned distal edges. It will furthermore be seen that the thumb receptacle commences at a base which is spaced from the distal edges by a distance in the order of magnitude of about 7 inches, the thumb receptacle having a width of about 2 inches at the aforementioned base and having a generally semi-circular end portion with a radius in the order of magnitude of about three-quarters of an inch.

In a preferred embodiment of the invention, the hand covering discussed above is part of a roll of hand coverings separated by lines of perforation to permit detachment. The hand coverings in the roll are relatively displaced in adjacent layers of the roll, so that the thumb, forefinger and further receptacles are relatively misaligned. This permits a fairly compact rolling of the film into a dispensable configuration avoiding the alignment of openings between the receptacles which would make the entire roll substantially asymetrical.

The invention also relates to a method which may be generally viewed as comprising bringing plastic films together in face-to-face relationship to form at least one glove and sealing the films together along a contour defining the above-mentioned thumb, forefinger and further receptacles. The films are sealed together along lateral edges bracketing the above-mentioned contour and the films are sealed together along the above-mentioned interior seals which are generally parallel to and spaced from the lateral edges mentioned above which merge with the latter to define the lateral receptacles. The films have edges which are distal from the contour as mentioned above and which remain detached from each other between the interior seals and between each interior seal and adjacent lateral edge.

In the method of the invention, there is formed a succession of gloves each having the aforesaid contours and lateral edges and provision is made for substantially simultaneously forming a lateral edge seal along one said lateral edge with two interior seals in successive gloves being concomitantly formed on opposite sides of the lateral edge seal.

As will be shown hereinbelow, the thusly sealed films are continuously wound onto a cylindrical core to form a roll. According to a feature of the method of the invention, first and second gears are arranged in successive first and second positions, these gears being rotated at a common speed. The above-mentioned core is arranged at a first position with a gear in mesh with the first gear to be driven thereby. The core is removed from the first position to the second position after the accumulation of a predetermined amount of film on the core, thereby to vacate the first position. The gear of the core is then engaged with the second gear at the second position to continue winding the film on the core. A replacement core is placed at the first position with a gear to be driven by the first gear and the winding of the film is switched from the first core to the replacement core by a technique which may involve the use of double-faced adhesive tape which is positioned on the replacement core.

According to the invention, certain tooling is provided to enable the practice of the method mentioned hereinabove. One such tool comprises a cylinder having a central axis and a sealing ridge on the cylinder parallel to and spaced from the aforesaid axis. The sealing ridge has opposite ends and further sealing ridges are placed on the cylinder on opposite sides of the first said ridge in such a manner that they are partly spaced from and parallel to the first said ridge at one end of the same but merge with the first said ridge at a position towards but spaced from the other end of the first said ridge.

According to a feature of this tooling, the first said ridge is of rectilinear shape and the ridges are all of the same height so as to be utilizable in a sealing technique.

The above and other objects, features and advantages of the invention will be found in the detailed description which follows hereinbelow as illustrated in the accompanying drawing.

DETAILED DESCRIPTION

Figure 1:
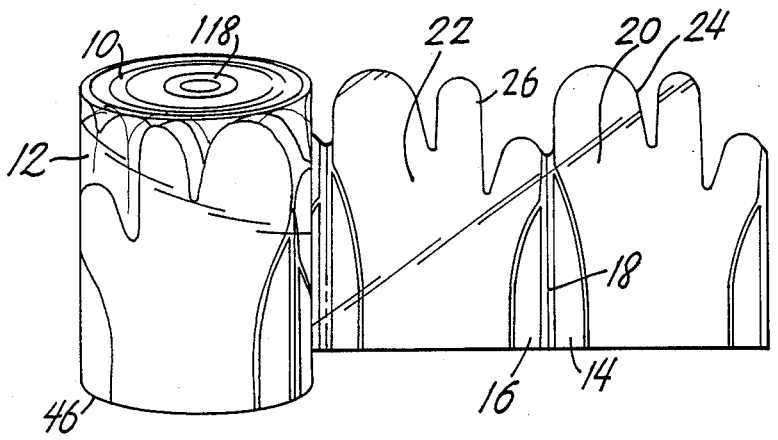
FIG. 1 is a diagrammatic view of a roll of film in which is provided a succession of gloves configured in accordance with the invention.

FIG. 1 illustrates a roll 10 of plastic film 12 having a sequence of sections provided therein. The sequence includes, for example, sections 14 and 16 which are separated or separable along lines or rows of perforations such as indicated at 18. The sections are inclusive of individual gloves such as for example gloves 20 and 22 having respective contours 24 and 26 which define thumb, forefinger and further receptacles. The further receptacles are capable of accommodating the three remaining fingers of the hand of a user. The gloves are formed of thin films of plastic such as polyethylene which are placed in face-to-face relationship and provided with peripheral and interior as well as lateral seals capable of forming the gloves and providing the various above-mentioned receptacles therein as well as two further lateral receptacles which have many and various usages. The details of one specific glove are shown in FIG. 2 along with the relevant dimensions of various sections of the illustrative glove.

Figure 2:
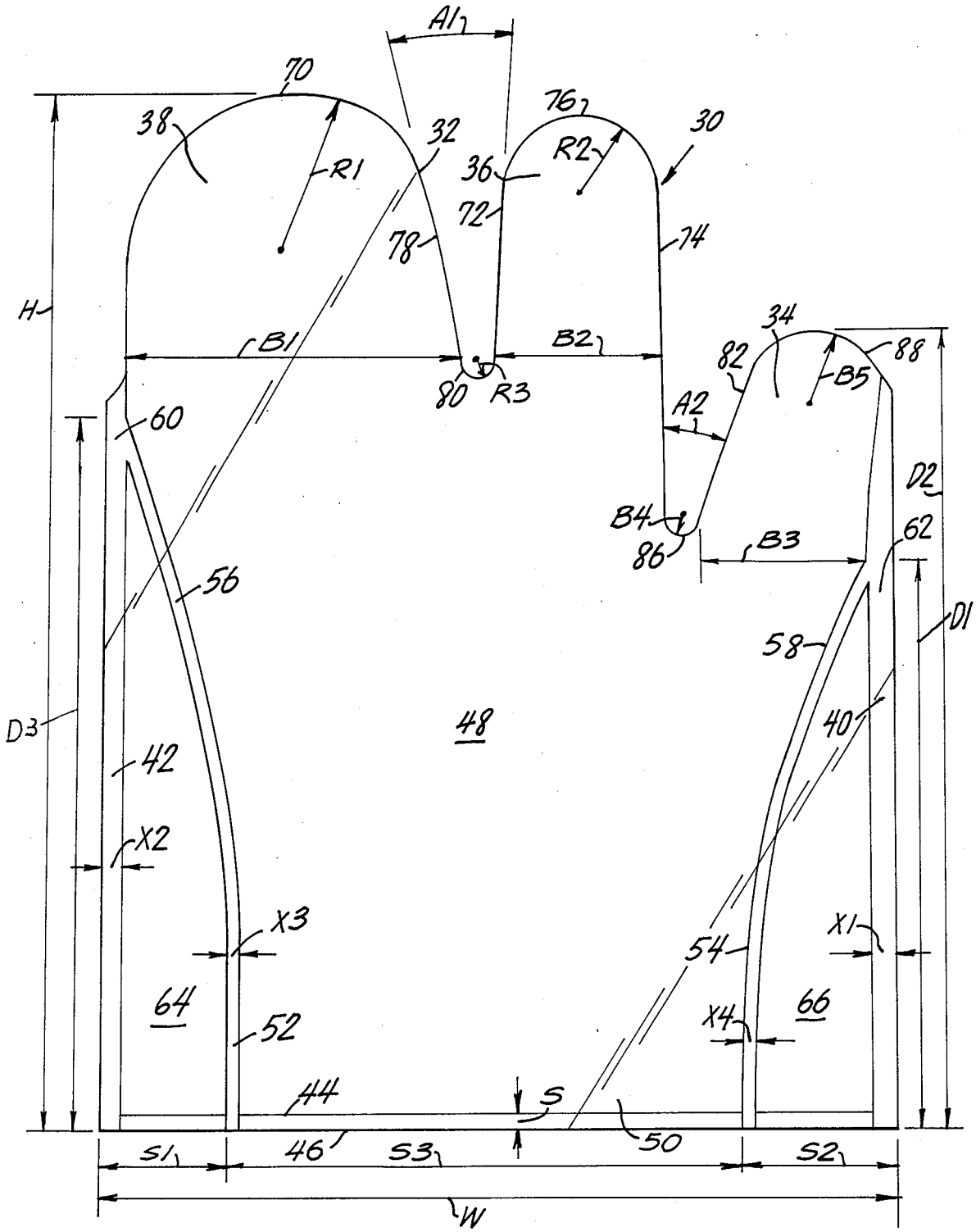
FIG. 2 is a plan view of a glove construction provided in accordance with the invention.

In FIG. 2 the example glove is indicated at 30. It includes a peripheral contour 32 which defines a thumb receptacle 34, a forefinger receptacle 36 and a further receptacle 38 which is capable of accommodating three fingers as has been mentioned hereinabove. The contour 32 is formed of a seal, the inner portion of which is an extremity of the glove and the outer portion of which is discarded. The section is also provided with two peripheral seals indicated at 40 and 42. These peripheral seals 40 and 42 constitute lateral-edge seals which define the lateral extremities of the section being described.

At the lower edge of the illustrated glove are the distal edges 44 and 46. These edges are separated from each other by a distance S which is in the order of magnitude of one-eighth of an inch. The reason for the spacing of these distal edges which are distal from the receptacles 34, 36 and 38 is to permit ready separation of the same and thereby access to the interior 48 of the glove through the throat 50 between the interior seals 52 and 54.

The interior seals 52 and 54 are seals formed between the upper and lower sheets of film. For a substantial portion, the seals 52 and 54 are parallel to the respective lateral edge seals 42 and 40. However, at portions 56 and 58, the interior seals move toward and merge with the lateral edge seals 42 and 40 meeting with the same at positions indicated at 60 and 62. The interior seals and the lateral-edge seals define lateral receptacles 64 and 66. These lateral pockets find many uses such as for example the accommodation of pencils or applicators or the like so that they are readily available when the gloves are put into use. It is also possible to place into these receptacles substances of various types such as may be used for medical treatment, beauty treatment and for gardening or the like. The interior seals 52 and 54 also perform the function of necking down the interior chamber 48 of the glove of the invention, thereby providing a throat between the interior seals which accommodates the wrist of the user and more readily shapes the glove to the hand of the user to prevent the detachment of the glove inadvertently from the hand which has been inserted into the same.

While not strictly limitative of the scope of the invention, the glove being described has preferred dimensions which constitute a particularly preferred embodiment thereof. More specifically, the section or glove has a height H of the order of magnitude of about 11 inches and a width W in the order of magnitude of about 8½ inches. The interior seal 52 is spaced from the lateral edge seal by a distance S1 in the order of magnitude of 1½ inches and the interior seal 54 is spaced from the lateral edge seal 40 by a distance which is indicated at S2 which is in the order of magnitude of about 1½ inches.

The distance S3 between interior seals 52 and 54 is in the order of magnitude of about 5½ inches. Preferably this distance S3 is generally from three to four times the magnitude of the distance between the interior seals and the respective lateral edge seals.

The seals themselves may be of various sizes and magnitude. Seals 40 and 42 have widths X1 and X2 which are in the order of magnitude of ¼ of an inch in the preferred version of the structure of the invention. In the same structure, the interior seals 52 and 54 have widths X3 and X4 which are in the order of magnitude of about ⅛ of an inch.

At the base of receptacle 38 there is a breadth B1 which is in the order of magnitude of about 3½ inches. The receptacle 38 terminates at its upper extremety 70 in a semicircular configuration which has a radius R1 in the order of magnitude of about 1½ inches.

Lateral edge 72 of receptacle 36 is generally parallel to lateral edge 74 of the same receptacle. These lateral edges 72 and 74 are spaced by a distance B2 having an order of magnitude of about 1½ inches. The receptacle 36 terminates upwardly in a semi-circular configuration indicated at 76 and having a radius R2 of about ¾ of an inch. The lateral edge 72 is spaced from the lateral edge 78 of the receptacle 38 in such a manner that edge 78 diverges from edge 72 defining therewith an angle A1 having an order of magnitude of about twenty degrees. Between lateral edges 72 and 78 is a curvature indicated at 80 and having a radius R3 having an order of magnitude of about 3/16ths of an inch.

The lateral edge 74 and lateral edge 82 of thumb receptacle 34 diverge from one another and define an angle A2 having an order of magnitude of about 25 degrees. These lateral edges also merge along a curvature 86 having a radius R4 which has an order or magnitude of about 3/16ths of an inch. Adjacent to this area, the base of receptacle 34 has a breadth B3 having an order of magnitude of about 2 inches. The thumb receptacle 34 terminates upwardly in a semi-circular portion indicated at 88 and having a radius R5 which has an order of magnitude of about ¾ of an inch.

The position 62 at which interior seal 58 merges with lateral edge seal 40 is a distance D1 of an order of magnitude of about 7 inches from the lowermost distal edge 46. The upper extremity of the thumb receptacle 34 terminates about a distance D2 having an order of magnitude from distal edge 46 of about 8½ inches. D3 is about 8 inches.

Figure 3:
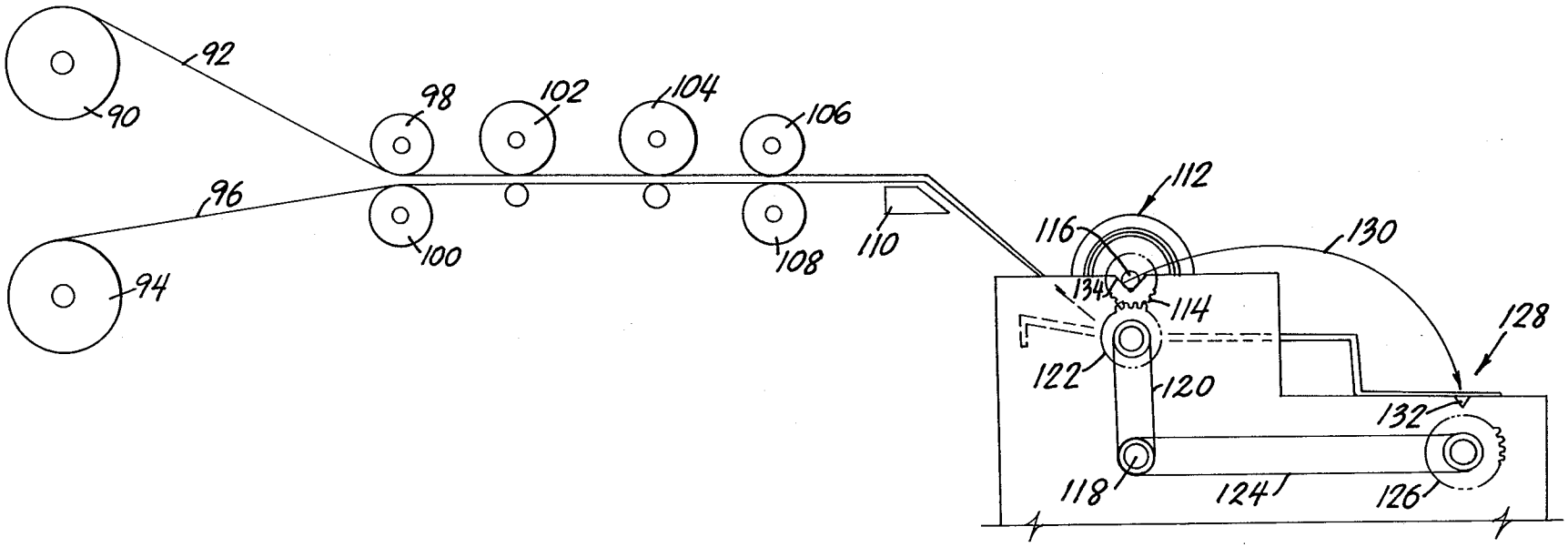
FIG. 3 is a diagrammatic illustration of an arrangement of film processing elements capable of manufacturing the gloves of the invention.

FIG. 3 illustrates the diagrammatic concept of how the glove of the invention is formed and how a roll of successive gloves as illustrated in FIG. 1 is brought to fruition. More particularly, there is provided a source 90 of plastic film 92 and a source 94 of plastic film 96 which films are brought together by means of rollers 98 and 100. These films are provided with the above-mentioned contour by a roller 102 and are provided with lateral edge and interior seals by a roller 104 whereafter perforations are provided by rollers 106 and 108.

Thereafter, the film is guided by a guide element 110 to a takeup station indicated at 112. This takeup station is provided with a gear 114 mounted on a shaft 116 which passes through a core 118 upon which the plastic is wound. The core 118 is shown more particularly in FIG. 1.

To enable a driving of the core or in other words a rotation of the same for purposes of winding up the thusly processed film, there is provided a drive shaft 118 which operates through a belt 120 to drive a gear 122 which meshes with the gear 114. The drive shaft 118 also operates through a belt 124 to drive a gear 126 at a station 128 which is the second in a succession of two stations at which winding up of the film takes place.

More particularly, when an operator has determined that almost an adequate number of gloves has been wound on the core at the station 112 by means of a counter (not shown), the shaft 116 is removed as indicated by arrow 130 to the second station 128. The shaft 116 is then deposited in the notch indicated at 132 all in a continuous motion with the film still being unbroken and therefore being continuously wound onto the core 118. The gear 114 then meshes with the gear 126 which rotates at the same speed as gear 122. As a result, continuous operation ensues.

The operator makes ready a replacement core during the operation of the machinery resulting in winding the thusly-processed film onto the core 118 before it is removed from the station indicated at 112. When the core and shaft are removed to station at 128, the replacement core with an appropriate replacement gear (not shown) is inserted into the notch 134 at station 112. When an exact count of gloves as determined by the operator has taken place, the operator parts the film being processed along one of the lines of perforations and attaches the same to the replacement core at station 112. This has been most readily effected by placing a double-faced adhesive tape (not shown) on the replacement core and attaching the free end of the processed film after severance on this tape whereupon taking up of the processed film on the new replacement core is effected.

Figure 4:
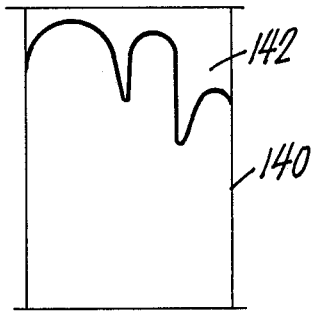
FIG. 4 illustrates the detail of a roll or roller employed in the apparatus of FIG. 3.

FIG. 4 illustrates a roll or roller 140 having thereon a ridge 142. The ridge is a sealing and cutting ridge which enables the contour inclusive of receptacles 34, 36, and 38 (see FIG. 2) to be burned into the two films which are thus sealed together along an appropriate contour and prepared for the removal of the excess material which is effected in any convenient and well-known manner.

Figure 5:
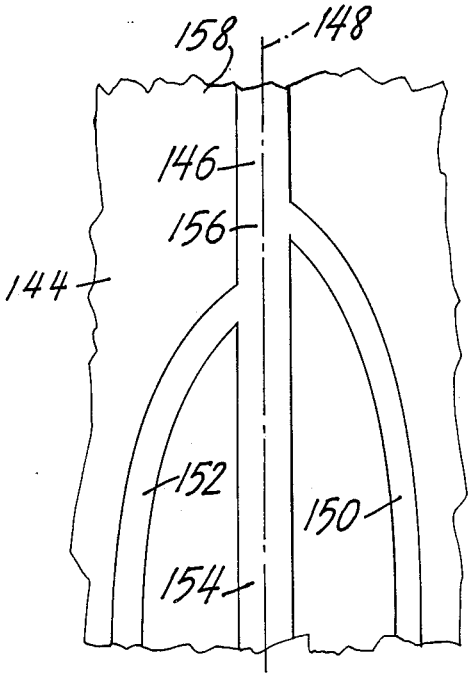
FIG. 5 is an illustration of a further roll employed in the apparatus of FIG. 3.

FIG. 5 illustrates a fragmentary portion of the roller 144 which is provided with a rectilinear ridge 146 which is parallel to the axis 148 of the roller 144. Since the ridge 146 is mounted on the surface of the roller 144, it follows that the ridge 146 is spaced from the axis 148 by approximately the radius of the roller 144. Supplemental ridges 150 and 152 are provided. The supplemental ridges are spaced from the ridge 146 at the end 154 thereof. Merger of the supplemental ridges 150 and 152 takes place at position 156 which is displaced further towards the end 158 of ridge 146 in correspondence with the interior seals 52 and 54 as illustrated in FIG. 2. It will be noted that ridges 150 and 152 are effective in successive sections of films being processed to form successive gloves being manufactured. Ridge 156 provides for the lateral edge seal between the two successive gloves such as the gloves 20 and 22 of FIG. 1. FIGS. 4 and 5 respectively show rollers 140 and 144 which are operative at stations 102 and 104 of FIG. 3. The contour of ridge 142 in FIG. 4 and the ridges 146, 150 and 152 of FIG. 5 may be provided in multiple replicas on the surfaces of each of the respective rollers according to the design of the equipment.

There will now be obvious to those skilled in the art, many modifications and variations of the structures and methods as well as the articles of manufacture set forth hereinabove. These modifications and variations will not depart from the scope of the invention if defined by the following claims.

What is claimed:

1. An article of manufacture comprising a hand cover including plastic films in face-to-face relation and having peripheral seals in part providing a contour defining thumb and forefinger receptacles and a further receptacle for three fingers, said films having sealed lateral edges and edges distal from said receptacles, said films having interior seals in generally spaced from said lateral edges, the edges distant from said receptacles being unconnected and therefore separable from each other except at said lateral and interior seals and between said interior seals defining an opening whereby access is provided for a hand, the interior seals merging with the peripheral seals adjacent the thumb and further receptacles, and the interior seals and the seals along the lateral edges defining lateral receptacles.

2. An article of manufacture as claimed in claim 1, where n the interior seals are spaced from each other by a distance which is about three to four times the distance between the interior seals and the related lateral edges.

3. An article of manufacture as claimed in claim 2, wherein the distance between the interior seals is in the order of magnitude of about five and one-half inches.

4. An article of manufacture as claimed in claim 3, wherein the distance between each said interior seal and related lateral edge is in the order of magnitude of about one and one-half inches.

5. An article of manufacture as claimed in claim 4, wherein the forefinger receptacle has generally parallel lateral edges spaced by a distance in the order of magnitude of about one and one-half inches.

6. An article of manufacture as claimed in claim 5, wherein said forefinger receptacles terminates in a generally semi-circular end seal having a radius in the order of magnitude of about three-quarters of an inch.

7. An article of manufacture as claimed in claim 6 wherein the forefinger and further receptacles have facing lateral edges which diverge at an angle relative to each other.

8. An article of manufacture as claimed in claim 7 wherein said angle is in the order of magnitude of about twenty degrees.

9. An article of manufacture as claimed in claim 7 wherein said further receptacle terminates in a generally semi-circular end seal which is part of said peripheral seal and has a radius in the order of magnitude of about one and one-half inches.

10. An article of manufacture as claimed in claim 6 wherein the lateral edges of the forefinger receptacle are generally parallel to the lateral edges of the films.

11. An article of manufacture as claimed in claim 8 wherein the thumb and forefinger receptacles having facing lateral edges which diverge at an angle in the order of magnitude of about twenty-five degrees.

12. An article of manufacture as claimed in claim 1 wherein the lateral edges of the film are spaced by a distance in the order of magnitude of about eight and one-half inches.

13. An article of manufacture as claimed in claim 7 wherein the facing lateral edges merge along a curvature having a radius in the order of magnitude of about three-sixteenths of an inch.

14. An article of manufacture as claimed in claim 11, wherein the facing lateral edges merge along a curvature having a radius in the order of magnitude of about three-sixteenths of an inch.

15. An article of manufacture as claimed in claim 1 wherein said thumb receptacle terminates at a distance in the order of magnitude of about eight and one-half inches from the distal edges.

16. An article of manufacture as claimed in claim 15 wherein said thumb receptacle commences at a base which is spaced from said distal edges by a distance in the order of magnitude of about seven inches, the thumb receptacle having a width of about two inches at said base and having a generally semi-circular end portion with a radius in the order of magnitude of about three-quarters of an inch.

17. An article of manufacture as claimed in claim 1 wherein said hand covering is part of a roll of hand coverings separated by lines of perforations to permit detachment.

18. An article of manufacture as claimed in claim 17 wherein the hand coverings are relatively displaced in adjacent layers of the roll so that the thumb, forefinger and further receptacles are relatively misaligned in the different layers.

19. A method comprising bringing plastic films together in face-to-face relationship to form at least one glove, sealing the films together along a contour defining a thumb, a forefinger, and a further receptacle with the further receptacle being adapted to accommodate three fingers, sealing the films together along lateral edges bracketing said contour, and sealing the films together along interior seals which are generally parallel to and spaced from said lateral edges for a portion of their lengths but which merge with the latter to define lateral receptacles, the films having edges which are distal from said contour and which remain detached from each other between said interior seals and between each interior seal and adjacent lateral edge whereby access is provided for a hand and access is provided for said lateral receptacles.

20. A method as claimed in claim 19 wherein lines of perforation are provided in correspondence with said lateral edges to provide for detachment along said lateral edges.

21. A method as claimed in claim 20 comprising forming a succession of gloves each having said contours and lateral edges, and forming a lateral-edge seal along one said lateral edge with two interior seals in successive gloves being concomitantly formed on opposite sides of the said one lateral edge seal.

22. A method as claimed in claim 21 comprising continuously winding the thus sealed films onto a cylindrical core to form a roll.

23. A method as claimed in claim 22 comprising arranging first and second gears in successive first and second positions and rotating said gears at a common speed, arranging said core at said first position with a gear in mesh with said first gear to be driven thereby removing said core from said first position to said second position after accumulating a predetermined amount of film on said core thereby to vacate said first position, engaging the gear of the core with said second gear to continue winding the film on said core, placing a replacement core at the first position with a gear to be driven by said first gear, and switching the winding of the film from the core to the replacement core.

24. A method as claimed in claim 23 comprising separating the sealed films into separate gloves by forming therein spaced parallel lines of perforations.

25. A method as claimed in claim 24 comprising arranging double faced adhesive tape on the replacement core, breaking the film along a line of perforations between the positions and bonding the film to the adhesive tape to continue the winding of the film on the replacement core.

* * * * *